US005562553A

United States Patent [19]

Digerness et al.

[11] Patent Number: 5,562,553

[45] Date of Patent: Oct. 8, 1996

[54] MULTI-PURPOSE GOLFER'S TOOL

[75] Inventors: Robert L. Digerness, 8328 E. Chapparal Rd., Scottsdale, Ariz. 85250; Chris M. Stalzer, Scottsdale, Ariz.; Scott C. Smith, Phoenix, Ariz.; Charles S. Lord, Scottsdale, Ariz.

[73] Assignee: Robert L. Digerness, Scottsdale, Ariz.

[21] Appl. No.: 586,989

[22] Filed: Jan. 16, 1996

Related U.S. Application Data

[63] Continuation-in-part of Ser. No. 36,818, Mar. 28, 1995, Pat. No. Des. 369,637, which is a continuation-in-part of Ser. No. 29,944, Oct. 19, 1994, abandoned.

[51] Int. Cl.[6] ..... A63B 57/00

[52] U.S. Cl. ..... 473/408; 473/406

[58] Field of Search ..... 473/406, 407, 473/408, 285, 286; 172/378, 379, 380; D21/234

[56] References Cited

U.S. PATENT DOCUMENTS

| | | | |
|---|---|---|---|
| D. 236,436 | 1/1976 | McKelvey | D9/346 |
| D. 237,516 | 11/1975 | Yaudes | D21/234 |
| D. 243,868 | 3/1977 | Williams, Jr. | D21/234 |
| D. 247,056 | 1/1978 | McClaskie | D21/234 |
| D. 249,574 | 9/1978 | Kralevich | D21/234 |
| D. 249,814 | 10/1978 | Cudahy, III | D21/234 |
| D. 253,420 | 11/1979 | Heerlies | D21/234 |
| D. 253,779 | 12/1979 | Kralevich | D21/234 |
| D. 253,788 | 12/1979 | Kralevich | D21/234 |
| D. 254,211 | 2/1980 | Gutknecht | D21/234 |
| D. 257,441 | 10/1980 | Kralevich | D21/234 |
| D. 264,369 | 5/1982 | Jackson | D21/234 |
| D. 272,461 | 1/1984 | Burns | D21/234 |
| D. 285,233 | 8/1986 | Owen | D21/234 |
| D. 290,634 | 6/1987 | Shumlas | D21/234 |
| D. 290,985 | 7/1987 | Dikoff | D21/234 |
| D. 300,160 | 3/1989 | Johnson | D21/234 |
| D. 300,760 | 4/1989 | Krokus, Sr. | D21/234 |
| D. 306,057 | 2/1990 | Vaughan, Jr. | D21/234 |
| D. 306,060 | 2/1990 | Washburn | D21/234 |
| D. 308,713 | 6/1990 | Sherry | D21/234 |
| D. 327,910 | 7/1992 | Cantlon | D21/234 |
| D. 328,117 | 7/1992 | Haugom | D21/234 |
| D. 331,090 | 11/1992 | Cellura | D21/234 |
| D. 336,124 | 6/1993 | Ordlock | D21/234 |
| D. 340,755 | 10/1993 | Shearer | D21/234 |
| D. 343,885 | 2/1994 | Willkie, Jr. | D21/234 |
| D. 345,776 | 4/1994 | Williams | D21/234 |
| D. 347,255 | 5/1994 | Kerr et al. | D21/234 |
| D. 369,637 | 5/1996 | Digerness et al. | D21/234 |
| 3,360,807 | 1/1968 | Mauck | 473/286 |
| 3,456,737 | 7/1969 | Rhyme | 473/408 |
| 3,539,017 | 11/1970 | Johnson | 473/408 |
| 3,622,157 | 11/1971 | Hatch | 473/406 |
| 3,763,515 | 10/1973 | Voss | 473/408 |
| 3,870,299 | 1/1974 | Howe | 473/408 |
| 4,086,678 | 10/1976 | Torr | D21/234 |
| 4,151,937 | 5/1979 | Jarosh et al. | 473/408 |

(List continued on next page.)

FOREIGN PATENT DOCUMENTS 2219513 12/1989 United Kingdom .

OTHER PUBLICATIONS

Flyer for Greensman Golf Tool from Greensman Golf Accessories, Inc. of Kingston, Ontario, Canada.

*Primary Examiner*—Steven Wong
*Attorney, Agent, or Firm*—Frank J. McGue

[57] ABSTRACT

A multipurpose golfer's tool is disclosed comprising a body and a divot repair tool slidably received within the body. The divot repair tool comprises a fork-like end and a distal end opposite the fork-like end. A cover is hingedly attached to the distal end and is positioned on the exterior of the body. The cover is easily manipulable to slide the divot repair tool from a retracted position within the body to an operating position. The cover also has a generally planar surface for imprinting indicia thereon. The tool further comprises a pencil sharpener mounted in the body, a detachable ball marker mounted on the body, and a club head groove cleaner mounted on the body.

12 Claims, 2 Drawing Sheets

U.S. PATENT DOCUMENTS

| | | | |
|---|---|---|---|
| 4,535,987 | 8/1985 | Dikoff | 473/406 |
| 4,998,726 | 3/1991 | Budnick | 473/406 |
| 5,022,650 | 6/1991 | Madock | 473/408 |
| 5,305,999 | 4/1994 | Tate | 473/408 |
| 5,388,824 | 2/1995 | Reimers | 473/408 |
| 5,393,052 | 2/1995 | Kennedy | 473/285 |
| 5,401,019 | 3/1995 | Wissman et al. | 473/408 |
| 5,405,133 | 4/1995 | Upton | 473/408 |
| 5,419,551 | 5/1995 | Hoyt et al. | 473/406 |
| 5,449,169 | 9/1995 | Hardin et al. | 473/408 |

MULTI-PURPOSE GOLFER'S TOOL

RELATED APPLICATIONS

This application is a continuation-in-part of Ser. No. 29/036,818, filed Mar. 28, 1995 entitled "MULTI-PURPOSE GOLFER'S TOOL", now U.S. Pat. No. D369,637 which is a continuation-in-part of Ser. No. 29/029,944, filed Oct. 19, 1994 entitled "MULTI-PURPOSE GOLFER'S TOOL", now abandoned.

TECHNICAL FIELD

This invention relates to a device useful to a golfer which is an assembly of golfer's tools, and, more particularly, to a device which comprises a packeted group of independent tools adapted for use during the playing of golf.

BACKGROUND OF THE INVENTION

Various types of golfer's tools have been described in the literature.

U.S. Pat. No. 5,388,824 entitled "Pocket Golf-Aid Device" which issued on Feb. 14, 1995 to Reimers discloses a device comprising an assembly of golf related accessories including a divot fixer, a probe like club face cleaner, and a wire brush slidably received within a housing. In addition, a detachable ball marker is also provided.

U.S. Pat. No. 5,419,551 entitled "Multi-Purpose Golf Tool" which issued on May 30, 1995 to Hoyt et al. shows a multi-purpose golfer's tool comprising a housing having a window therein, a score wheel, a brush, a fork for divot repair, a belt clip and a ball marker.

U.S. Pat. No. 4,535,987 entitled "Golf Tool" which issued Aug. 20, 1985 to Dikoff discloses a multi-purpose tool having divot repair legs, a knife edge sharpener, a groove cleaning tip and a ball marker.

U.S. Pat. No. Des. 336,124 entitled "Combined Golf Tool and Pencil Sharpener" which issued Jun. 1, 1993 to Ordlock shows a combination divot tool and pencil sharpener.

U.S. Pat. No. Des. 237,516 entitled "Multiple Purpose Golf Tool" which issued Nov. 4, 1975 to Yaudes shows what appears to be sliding tines on one end and raised ridges on the opposite end of the device.

U. K. Patent GB 2 219 513 A entitled "Golfing Aid" which was published on Dec. 13, 1989 provides a golfing aid having divot repair tines, a ball marker and groove cleaning brush.

None of the known prior art disclose the combination which comprises the device set forth herein.

SUMMARY OF THE INVENTION

It is an object of this invention to provide a combination of tools in one device, each tool being separably operable by hand as required.

It is a further object of this invention to provide the combination of tools in a small housing which can be easily carried by a user in a pocket.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
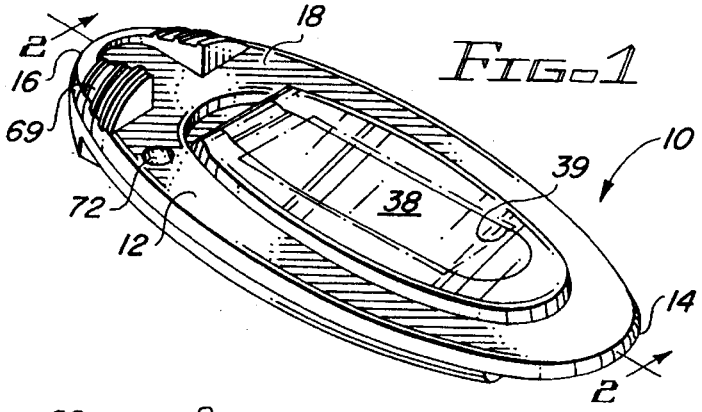
FIG. 1 is a perspective view of one embodiment of the present invention with a divot repair tool in a recessed position.

Referring more particularly to the drawings by characters of reference, FIGS. 1–11 disclose a multi-purpose golfer's tool 10 which includes an oval body 12 having rounded front and rear portions 14 and 16, respectively. Body 12 includes a top half 18 and a bottom half 20 which are joined to one another after placement of the inner components described below. Top half 18 and bottom half 20 are suitable for placement of indicia thereon if desired.

In the preferred embodiment, such joining is accomplished by pins and corresponding holes (not shown) in top half 18 and bottom half 20. However, those skilled in the art will recognize that many other means of joining are suitable for use with the present invention.

Figure 3A:
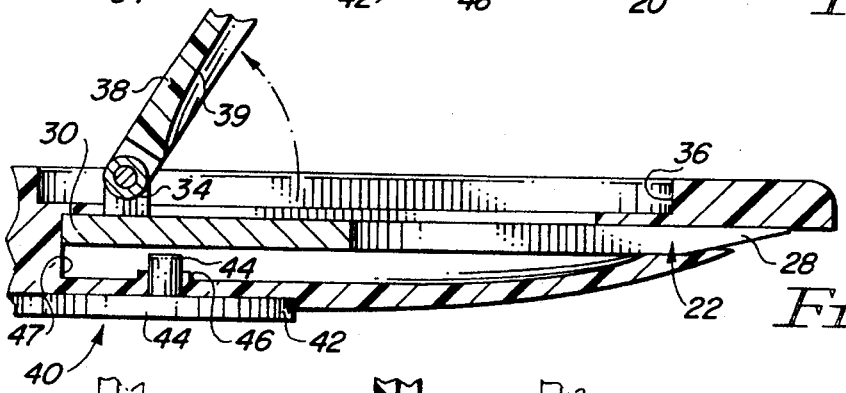
FIG. 3A–3C is a cross sectional view taken along line 2—2 showing movement of the divot repair tool from the recessed position to a operating position.
Figure 3B:
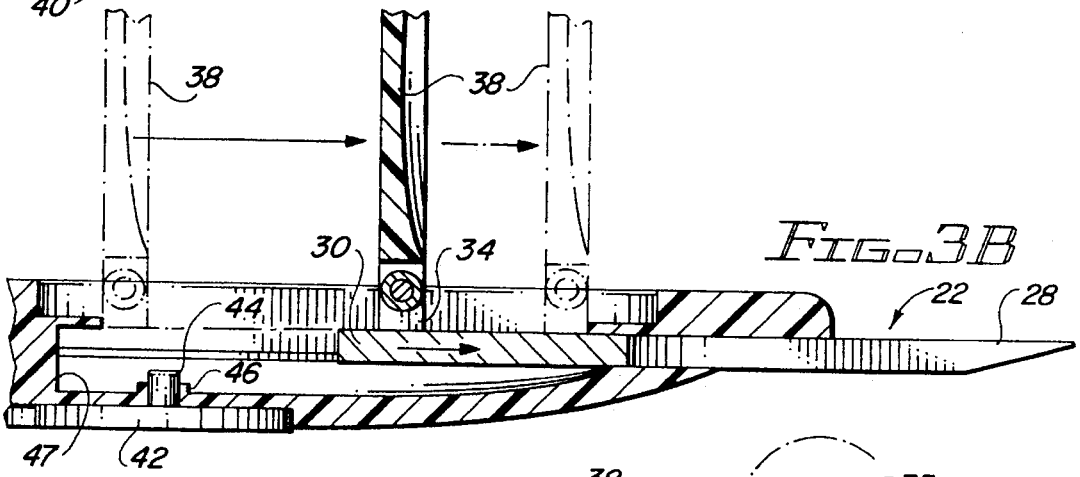
Figure 3C:
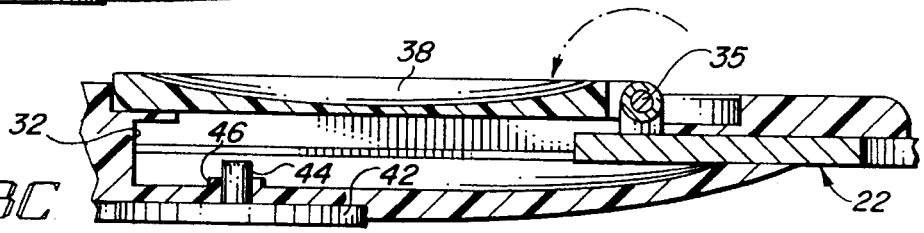
Figure 4:
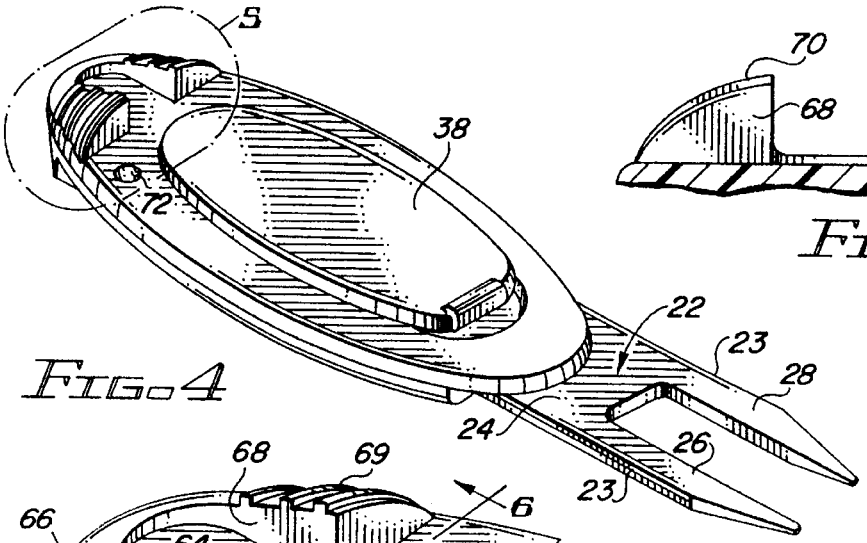
FIG. 4 is a perspective view of the embodiment of FIG. 1 with the divot repair tool in the operating position.

As shown in FIGS. 1, 3A–3C, 4 and 10, a fork-like divot repair tool 22 is slidably received between the upper and lower halves 18 and 20 of body 12, the interior of body 12 being cut away to accommodate platen 24 of divot repair tool 22. As best seen in FIG. 4, the divot repair tool 22 is generally of a fork-like configuration and consists of two laterally spaced tines 26, 28. Tool 22 is safely stored within body 12 when slidably received within body 12 when not in use, thereby protecting the user from damage to skin, clothing and the like which might otherwise be caused by extended tines 26, 28.

In the presently preferred embodiment, tool 22 is manufactured from aluminum. Tool 22 is optionally finished with gold, brass or chrome.

When tool 22 is extended, body 12 of device 10 is used as a handle thereby increasing the leverage to a user over prior art divot repair tools. In addition, device 10 can be inserted into the ground to function as a club stand to prevent club grips from becoming wet or dirty.

Figure 10:
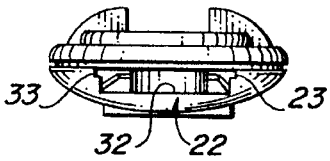
FIG. 10 is a front view of the embodiment of FIG. 1.

Opposite tines 26, 28, the distal end 30 is received within a cavity 32 within body 12. As best seen in FIG. 10, cavity 32 further includes two tracks 33 which receive corresponding arms 23 which extend laterally from tool 22. Tracks 33 and arms 23 cooperate to firmly maintain the proper orientation for tool 22 when being slid in and out of cavity 32.

Figure 2:
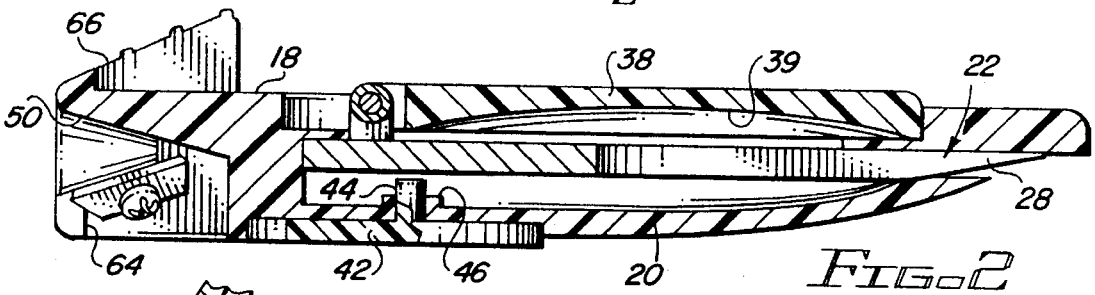
FIG. 2 is cross sectional view taken along line 2—2 in FIG. 1.

A post 34 is mounted on distal end 30 and extends upwardly from divot repair tool 22 to project through an opening 36 formed in the upper half 18 of body 12. A cover 38 is removably and hingedly mounted to post 34 via pins 35 extending into post 34. Cover 38 serves as a manual control for sliding post 34 and hence divot repair tool 22 from a retracted position shown in FIGS. 1 and 7 to an operating position shown in FIG. 4 and in shadow in FIG. 7. To improve the ease of use of cover 38, a recessed thumb grip 39 is provided. Cover 38 is symmetrical whereby it overlies opening 36 when the divot repair tool 22 is in both the retracted position as shown in FIGS. 1 and 2 or the operating position as shown in FIGS. 4 and 3C.

Cover 38 is preferably transparent whereby indicia on one side are visible from the other side. Indicia can include advertising or any other messages as desired. Cover 38 can be removed and replaced in the event that such indicia become damaged.

Figure 9:
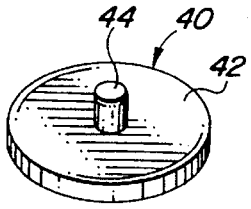
FIG. 9 is a perspective view of a ball marker which is a component of the present invention.

As shown in FIGS. 2–3C and 7, and as best seen in FIG. 9, a ball marker 40 includes a disk 42 having an integrally formed shaft 44 removably secured to body 12 of the golfer's tool 10 in bottom half 20. The upper portion of disk 42 is suitable for receiving indicia as well.

Figure 7:
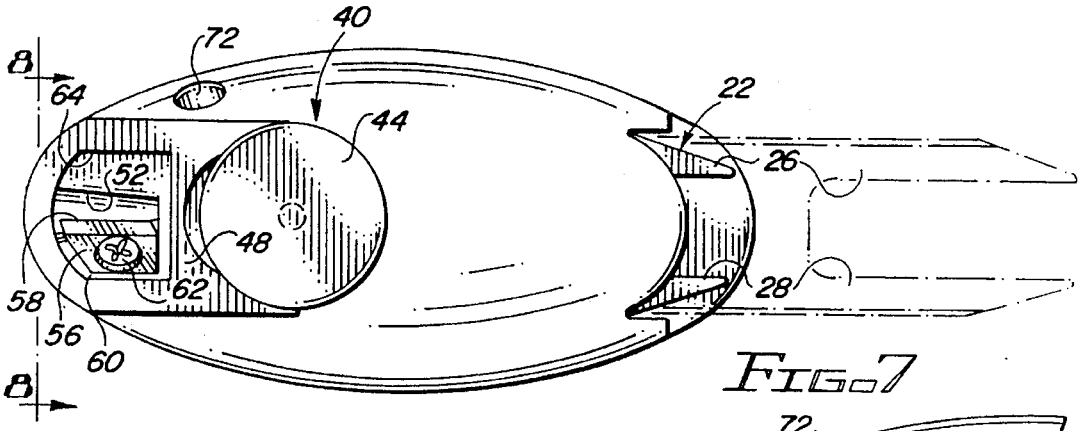
FIG. 7 is a top view of the embodiment of FIG. 1.

The shaft 44 is matingly received within a cooperating cylindrical bore 46 formed in bottom half 20 and opening downwardly. As best seen in FIGS. 2, 3A–3C, bore 46 includes cylindrical sidewalls 47 which are resiliently urged inwardly to firmly grasp shaft 44 in a pincer action. As shown in FIG. 7, the bottom half 20 is cut away proximate to ball marker 40 to define a recess 48 to facilitate finger access to disc 42 during dislodgement of ball marker 40.

Figure 11:
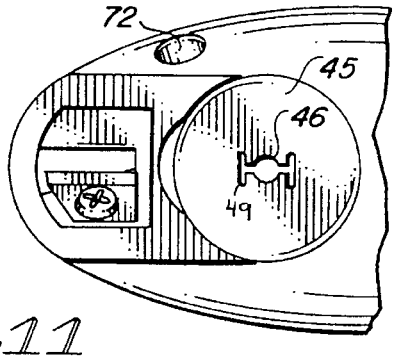
FIG. 11 is a partial bottom view of an alternate embodiment of the present invention.

An alternate embodiment of bore 46 is best seen in FIG. 11 cut in a flat area 45 which correspondingly receives disk 42. In this embodiment, bore 46 is slightly smaller than shaft 44 but cutouts 49 on either side of bore 46 provide enough flexibility enough to allow shaft 44 to extend therein. The inner edges of bore 46 then pinch to firmly but releasably receive shaft 44 therein.

At end 16 opposite end 14 where divot repair tool 22 resides, body 12 includes a pencil sharpener 50 suitable for use with a typical golf pencil. Such pencils generally have a more stubby conical shape than a typical pencil. Thus, pencil sharpener 50 comprises a passage 52 generally having a conical shape corresponding to the typical golf pencil which is formed along the midline of the body 12. A slot 54 is defined in the lower wall of passage 50 which extends the length of passage 50. The length of passage 50 is approximately one half the length of a normal pencil sharpener to accommodate the typical stubby golf pencil. A blade 56 includes a cutting edge 58 which extends through slot 52 and is oriented parallel to the sloping side of conical passage 54. Slot 52 connects passage 54 with a pencil shavings recess 64 in the bottom half 20 of body 12. Blade 56 also includes a mounting portion 60 integral with the cutting edge 58. Mounting portion 60 and is detachably mounted into recess 64 the body 12 preferably via a screw 62 which allows replacement of blade 56 when dulled.

To use, the tip of the golf pencil (not shown) is inserted into passage 54 and rotated against circumferentially oriented cutting edge 58 and is thereby sharpened. The shavings from the pencil are directed by cutting edge 58 through slot 52 into recess 64 and thus drop from body 12.

Figure 6:
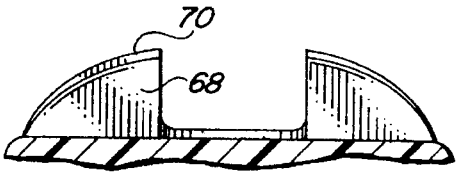
FIG. 6 is cross sectional view taken along line 6—6 of FIG. 5.
Figure 5:
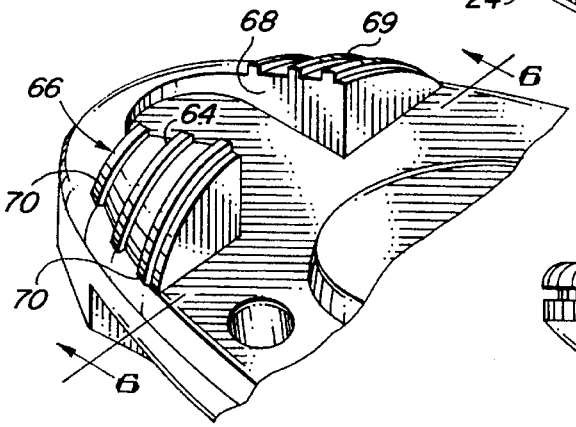
FIG. 5 is a close up view of the area circled 5 in FIG. 4.
Figure 8:
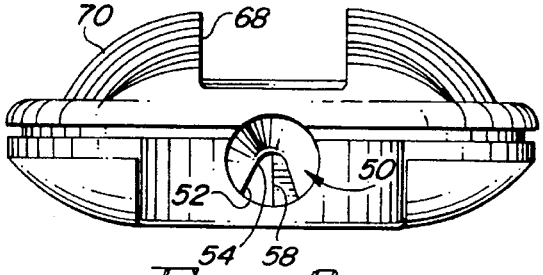
FIG. 8 is a rear and partial cross sectional view taken along line 8—8 of FIG. 7.

As best seen in FIGS. 5, 6 and 8, mounted on the top half 18 of body 12 is a groove cleaner 66 comprising a U-shaped base 68 presenting an arcuate surface 69 angled away from the plane body 12 and having a plurality of raised ribs 70 thereon. The orientation of surface 69 allows the user to grip body 12 with the hand. If surface 69 were in the plane of body 12, the user would be forced to grasp body 12 along its sides only. Ribs 70 are thin and correspond in width to the grooves found on the head of a golf club (not shown). The ribs are used to scrape grass, dirt and the like which can accumulate in such golf club head grooves.

A hole 72 extending through body 12 as shown in FIGS. 4 and 7 can be provided for attachment of device 10 to a keychain and the like.

Although only certain embodiments have been illustrated and described, it will be apparent to those skilled in the art that various changes and modifications may be made therein without departing from the spirit of the invention or from the scope of the appended claims. For example, groove cleaner 66 could be replaced with a nylon brush if desired.

What is claimed is:

1. A multipurpose golfer's tool, the tool comprising:

a body;

a divot repair tool slidably received within the body, the divot repair tool comprising a fork-like end and a distal end opposite the fork-like end;

a cover hingedly attached to the distal end, the cover being positioned on the exterior of the body and being easily manipulable to slide the divot repair tool from a retracted position within the body to an operating position, the cover having a generally planar surface for imprinting indicia thereon;

a pencil sharpener mounted in the body;

a detachable ball marker mounted on the body; and a club head groove cleaner mounted on the body.

2. The tool as set forth in claim 1 wherein the body is an oval body having rounded front and rear portions, the body having a top half and a bottom half, the top half and the bottom half being joined together.

3. The tool as set forth in claim 2 wherein the divot repair tool is slidably received between the top and bottom halves.

4. The tool as set forth in claim 1 wherein the cover is hingedly mounted to a post integral with the distal end.

5. The tool as set forth in claim 1 further comprising an opening in the exterior of the body and wherein the cover is symmetrical such that the cover is received in opening when the divot repair tool is in both the retracted position and the operating position.

6. The tool as set forth in claim 5 wherein the cover is transparent whereby indicia on one side are visible from the other side.

7. The tool as set forth in claim 1 wherein the ball marker comprises a disk having a shaft extending from the underside thereof, the body having a corresponding bore, the shaft adapted matingly to seat within the bore to secure the ball marker to the body.

8. The tool as set forth in claim 1 wherein the pencil sharpener comprises a passage having a conical shape formed in the body, the pencil sharpener further having a slot in the passage, the pencil sharpener further comprising a blade having a cutting edge extending through the slot, the cutting edge being parallel to the sloping side of the passage.

9. The tool as set forth in claim 8 wherein the body further defines a recess which opens from the slot to the exterior of the body, the blade, the slot and the recess cooperating to direct pencil shavings to the outside of the body.

10. The tool as set forth in claim 8 wherein the blade further comprises a mounting portion integral with the cutting edge, the mounting portion being detachably mounted to the body.

11. The tool as set forth in claim 10 wherein the groove cleaner comprises a U-shaped base having a sloping arcuate surface and a plurality of raised ribs mounted thereon.

12. A multipurpose golfer's tool, the tool comprising:

an oval body having rounded front and rear portions, the body having a top half and a bottom half, the top half and the bottom half being joined together, the body defining an opening in the exterior of the body;

a divot repair tool slidably received between the top and bottom halves of the body, the divot repair tool comprising a fork-like end and a distal end opposite the fork-like end;

a cover hingedly attached to the distal end, the cover being positioned in the opening on the exterior of the body, the cover being easily manipulable to slide the divot repair tool from a retracted position within the body to an operating position, the cover being symmetrical such that the cover is received in the opening when the divot repair tool is in both the retracted position and the operating position, the cover having a generally planar surface for imprinting indicia thereon, the cover being transparent whereby the indicia are visible when the divot repair tool is in both the retracted position and the operating position;

a pencil sharpener mounted in the body, the pencil sharpener comprising a passage having a conical shape formed in the body, the pencil sharpener further having a slot in the passage, the pencil sharpener further comprising a blade having a cutting edge extending through the slot, the blade being detachably mounted to the body, the cutting edge being parallel to the sloping side of the passage, the body further defining a recess opening from the slot to the exterior of the body, the blade, the slot and the recess cooperating to direct pencil shavings to the outside of the body;

a detachable ball marker comprising a disk having a shaft extending from the underside thereof, the body having a corresponding bore, the shaft being adapted to seat within the bore to secure the ball marker to the body; and a club head groove cleaner mounted on the body, the groove cleaner comprising a U-shaped base having a sloping arcuate surface and a plurality of raised ribs mounted thereon.

* * * * *